US010821325B2

(12) United States Patent
Trevino

(10) Patent No.: US 10,821,325 B2
(45) Date of Patent: Nov. 3, 2020

(54) BALANCING PUSH UP BAR

(71) Applicant: Jose A. Trevino, Tucson, AZ (US)

(72) Inventor: Jose A. Trevino, Tucson, AZ (US)

( * ) Notice: Subject to any disclaimer, the term of this patent is extended or adjusted under 35 U.S.C. 154(b) by 88 days.

(21) Appl. No.: 15/961,588

(22) Filed: Apr. 24, 2018

(65) Prior Publication Data

US 2019/0009137 A1 Jan. 10, 2019

Related U.S. Application Data

(60) Provisional application No. 62/528,967, filed on Jul. 5, 2017.

(51) Int. Cl.

| | |
|---|---|
| ***A63B 26/00*** | (2006.01) |
| ***A63B 23/12*** | (2006.01) |
| ***A63B 23/02*** | (2006.01) |
| ***A63B 21/00*** | (2006.01) |
| ***A63B 23/035*** | (2006.01) |
| ***A63B 22/16*** | (2006.01) |
| ***A63B 21/068*** | (2006.01) |

(52) U.S. Cl.

CPC ..... *A63B 26/003* (2013.01); *A63B 21/0004* (2013.01); *A63B 21/068* (2013.01); *A63B 22/16* (2013.01); *A63B 23/0211* (2013.01); *A63B 23/03525* (2013.01); *A63B 23/1236* (2013.01); *A63B 21/4034* (2015.10); *A63B 21/4035* (2015.10); *A63B 2225/09* (2013.01); *A63B 2225/093* (2013.01)

(58) Field of Classification Search

CPC ... A63B 26/003; A63B 22/16; A63B 23/1236; A63B 23/03525; A63B 23/02; A63B 23/0205; A63B 23/0211; A63B 23/0216; A63B 23/0222; A63B 21/0004; A63B 21/068; A63B 21/4034; A63B 21/4035; A63B 21/0724; A63B 21/078; A63B 2225/09; A63B 2225/093; A63B 2208/0295

See application file for complete search history.

(56) References Cited

U.S. PATENT DOCUMENTS

| | | | | | |
|---|---|---|---|---|---|
| 3,471,144 | A * | 10/1969 | Lemaire | A63B 22/16 | 482/146 |
| 4,285,516 | A * | 8/1981 | Heatwole | A63B 21/0004 | 482/146 |
| 5,713,823 | A * | 2/1998 | Walendzak | A63B 22/18 | 482/139 |
| 5,772,563 | A * | 6/1998 | Lin | A63B 23/0211 | 482/121 |
| 5,897,474 | A | 4/1999 | Romero | | |
| 7,115,052 | B2 * | 10/2006 | Wardle | A63B 69/38 | 473/459 |
| 7,291,103 | B1 * | 11/2007 | Estwanik | A61H 1/0237 | 482/148 |
| 7,563,216 | B1 * | 7/2009 | Kest | A63B 22/16 | 482/140 |

(Continued)

*Primary Examiner* — Loan B Jimenez
*Assistant Examiner* — Kathleen Vermillera

(57) ABSTRACT

A balancing push up bar effective for strengthening core muscles is provided. The balancing push up bar includes a bar coupling a front arc and a rear arc. A shape profile of the front and the rear provide a rocking movement of the balancing push up bar. A user may be able to mount the bar and perform push up exercises while balancing on the bar, which strengthens and tones the core muscles.

1 Claim, 6 Drawing Sheets

(56) References Cited

U.S. PATENT DOCUMENTS

| | | | | |
|---|---|---|---|---|
| 8,357,077 | B2 | 1/2013 | Taylor et al. | |
| 8,632,445 | B2 | 1/2014 | Kim et al. | |
| 8,814,768 | B1 | 8/2014 | Yang et al. | |
| 10,004,943 | B2 * | 6/2018 | Ho | A63B 23/0205 |
| 10,456,617 | B1 * | 10/2019 | Allison | A63B 22/16 |
| 2004/0110604 | A1 * | 6/2004 | Chen Wu | A63B 22/16 482/79 |
| 2009/0215597 | A1 * | 8/2009 | Fernandez | A63B 22/18 482/146 |
| 2011/0251031 | A1 * | 10/2011 | Mayr | A63B 22/0087 482/121 |
| 2019/0262650 | A1 * | 8/2019 | Bolillo | A63B 17/02 |

* cited by examiner

BALANCING PUSH UP BAR

CROSS REFERENCE

This application claims priority to U.S. Provisional Patent Application No. 62/528,967, filed Jul. 5, 2017, the specification(s) of which is/are incorporated herein in their entirety by reference.

FIELD OF THE INVENTION

The present invention relates to the field of exercise devices. More particularly, the present invention relates to the field of balancing push up bars.

BACKGROUND OF THE INVENTION

Pushups are strength training exercises performed in different positions to selectively work out different muscles in body. A wide variety of methods and devices are used as aids in exercising and in balance training.

For example, U.S. Pat. No. 5,897,474 by Romero discloses a rectangular shaped platform coupled to a semi flexible ball member. Therein, a user performs pushups on the platform by holding the platform on the ground while balancing on the ball member. Another such device is a push up exercise device with a rocker, a balance indicator, and a hinged balance roller, as disclosed in U.S. Pat. No. 7,563,216 B1 by Kest. Therein, the user's body is positioned over the push-up exercise device, and wherein an upper portion of the body is above the push-up exercise device, while a lower portion of the body extends distally away from said push-up exercise device, resting on the ground, for example. The user lowers and raises the upper portion of the body towards and away from the device, while simultaneously maintaining balance of the device.

However, both Romero and Kest work only the muscles of the upper body. The present invention includes additional mechanisms for balancing both the upper and the lower parts of the body while performing push up exercises on a balancing push up bar, thereby expanding the range of benefits when performing the exercises.

SUMMARY OF THE INVENTION

The present invention discloses a balancing push up bar that comprises a front block coupled to a rear block via a bar. Without wishing to limit the invention to a particular mechanism, an arc-shaped profile of the front and the rear block provides for a side-to-side or a rocking movement of the bar.

In some aspects, the present invention discloses a balancing push up bar for exercising and strengthening core muscles of a user. As will be disclosed here, the push up bar may include a front block, a rear block, and a bar coupling the front block to the rear block. The push up bar may additionally include a first extender disposed on the front block and extending therefrom towards a first side and a second extender disposed on the front block and extending therefrom towards a second side that is opposite of the first side, wherein a shape profile of each of the front block and the rear block may provide a rocking motion of the balancing push up bar, wherein when the balancing push up bar is in use, the user can hold onto the first extender and the second extender and rests a lower portion of the user's body on the rear block, wherein the user uses a body force to control movement and balance on the push up bar.

In some embodiments, the front block and the second block may be parallel to each other and orthogonal to the bar. In some embodiments, the shape profile of the front block may comprise a first arc and the shape profile of the rear block comprises a second arc, wherein the first arc and the second arc may create a rocking motion such that the push up bar rocks to and from the first side and the second side.

In some embodiments, the first arc may comprise a grip pad coupled to a bottom portion of the first arc, the grip pad configured to assist in holding the push up bar and reduce slipping of the push up bar. Additionally or alternatively, the first extender and the second extender may be detachably coupled to the front block, and wherein the first extender and the second extender may comprise a first set of handles for the user to hold onto while balancing on the push up bar.

In some embodiments, the front block may comprise a front pad disposed on a top portion of the front block, said front pad having a second set of handles for the user to hold while balancing on the push up bar. Additionally or alternatively, the rear block may comprise a pad removably coupled to a top surface of the rear block. In some embodiments, the user may rest feet or knees on a top padding that is removably coupled to the pad. Additionally or alternatively, the top padding may further comprise a grip tape configured to provide grip support to the feet of the user. In some embodiments, the bar may be a telescoping bar. In some embodiments, the bar may comprise a locking lever, the screw configured to lengthen or shorten the bar, and further configured to lock the bar to maintain the bar stationary.

In some aspects, the present invention discloses a method of performing a balancing exercise, the method comprising providing a balancing push up bar as disclosed herein, operating the push up bar in a first mode, the first mode configured to maintain a first position of the user wherein arms of the user rest on the front block while feet rest on the rear block, wherein both the front block and the rear block of the push up bar rock from the first side to the second side and the user maintains, the first position while balancing rocking movement of the front block and the rear block, thereby simultaneously exercising both the upper and lower body of the user. The method may additionally include operating the push up bar in a second mode, the second mode configured to maintain a second position of the user by shortening a length of the bar, wherein the arms of the user rest on the front block while knees rest on the rear block, thereby allowing the user to perform push ups on the knees while simultaneously balancing on the push up bar. The method may additionally include operating the push up bar in a third mode, the third mode configured to move the bar by unlocking, the locking lever and allowing both the upper and the lower body to move in different directions, thereby further strengthening the core of the user.

According to some embodiments, a balancing push up bar is provided. The balancing push up bar may include a bar coupling a front block to a rear block, the coupling allowing a user to maintain a push up position on the bar while countering a movement of the bar, the movement resulting from a shape profile of each of the front block and the rear block, wherein maintaining the position includes positioning arms on the front block and knees or feet on the rear block, thereby simultaneously exercising both upper and lower body of the user. In some embodiments, the bar may comprise a telescoping bar, the telescoping bar comprising a rotating locking mechanism that allows the bar to be lengthened or shortened.

According to some embodiments, a balancing push up bar for exercising core muscles is provided. The balancing push bar may include a first arc coupled to a second arc via a bar, wherein the first arc and the second arc creates a side-to-side rocking movement of the push up bar. In some embodiments, the first arc may comprise a rod positioned orthogonal to the bar, wherein a user holds onto the rod coupled to the first arc and rests feet on the second arc, and wherein the user performs push ups while balancing the rocking movement. In some embodiments, the rod may be detachably attached to the first arc.

In some embodiments, a length of bar may be adjustable, and wherein the bar may comprise a locking lever configured to lock the bar at a desired length while balancing on the push up bar. In some embodiments, the bar may comprise a telescoping bar. In some embodiments, the bar may be coupled to each of the first arc and the second arc by a plurality of screws. In some embodiments, the second arc may comprise a railing on which tops may be interchangeably attached to the second arc. In some embodiments, the top may comprise a grip tape.

One of the unique and inventive technical features of the present invention is that by positioning the arms and legs on two different blocks, both of which are configured to undergo rocking movement, the user may be able to undergo a full body workout in the push up position. In addition to strengthening the core muscles by balancing both the upper body and the lower body on separate blocks, the user may additionally perform pushups while balancing on the bar to get additional workout benefits. Without wishing to limit the invention to any theory or mechanism, it is believed that the technical feature of the present invention advantageously provides for working all the upper and lower body muscles equally in order to be able to stay balanced on the bar, thereby providing complete strengthening of the muscles. None of the presently known prior references or work has the unique inventive technical feature of the present invention.

Any feature or combination of features described herein are included within the scope of the present invention provided that the features included in any such combination are not mutually inconsistent as will be apparent from the context, this specification, and the knowledge of one of ordinary skill in the art. Additional advantages and aspects of the present invention are apparent in the following detailed description and claims.

BRIEF DESCRIPTION OF THE DRAWINGS

The features and advantages of the present invention will become apparent from a consideration of the following detailed description presented in connection with the accompanying drawings in which.

DESCRIPTION OF PREFERRED EMBODIMENTS

Figure 1A:
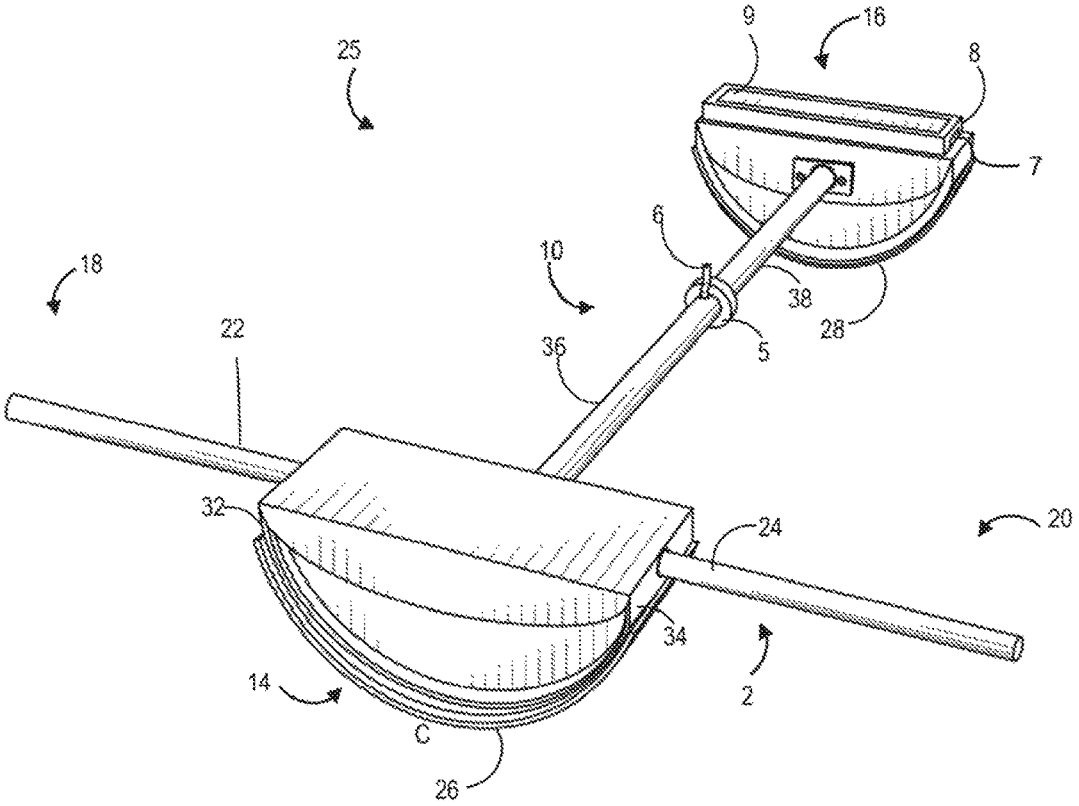
FIG. 1A shows a perspective view from the right of a non-limiting example of a balancing push up bar.
Figure 1B:
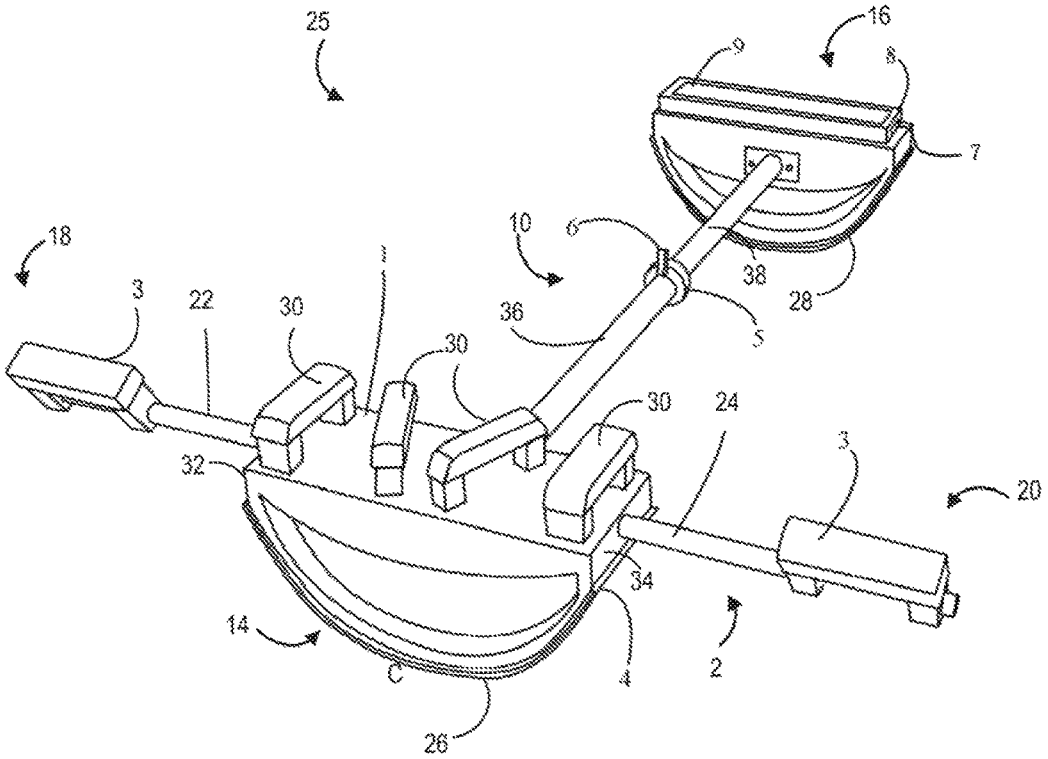
FIG. 1B shows a perspective view from the right of a non-limiting example of a balancing push up bar with handles.
Figure 2:
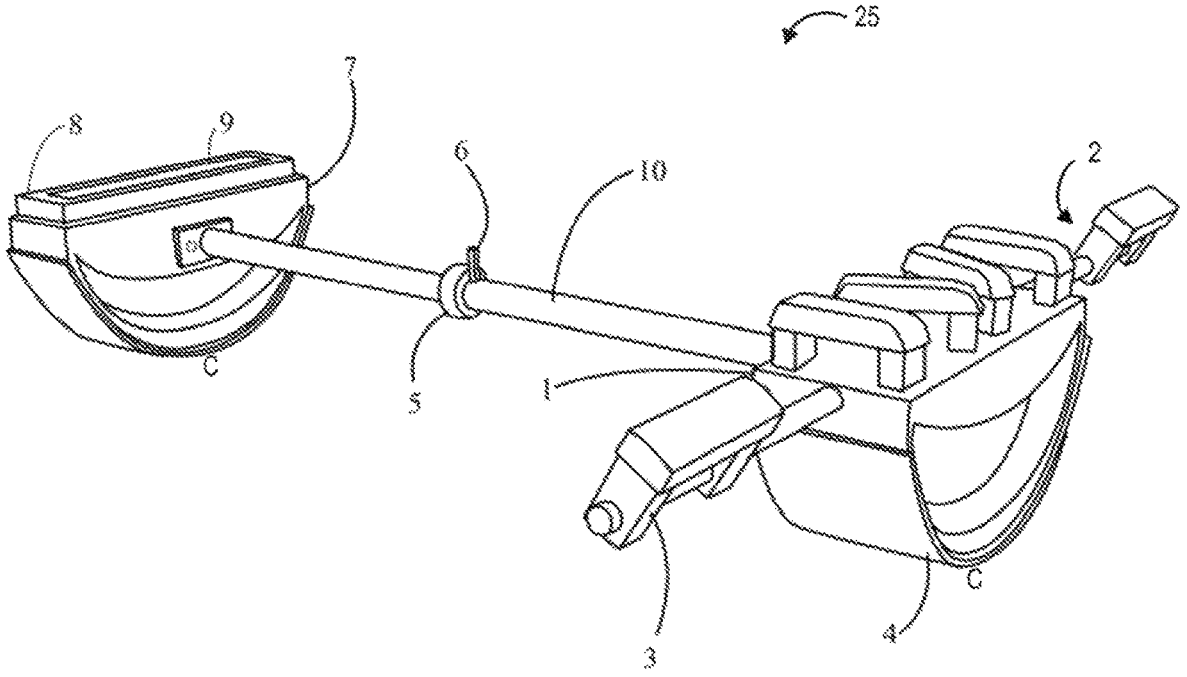
FIG. 2 shows a perspective view from the left of the balancing push up bar.
Figure 3:
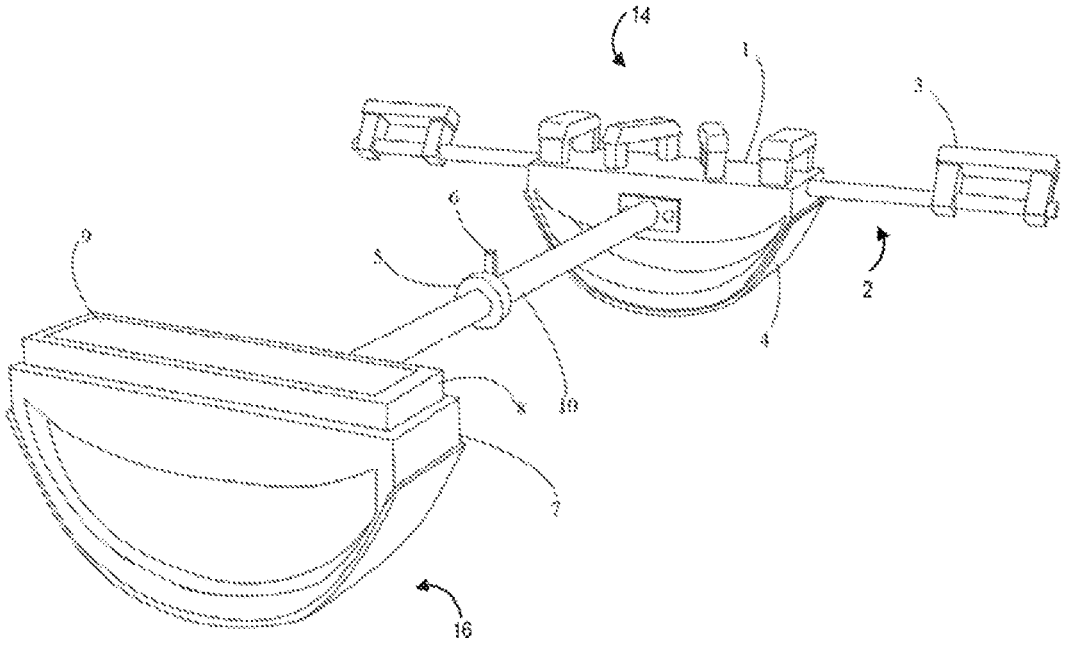
FIG. 3 shows a perspective view from the rear loft of the balancing push up bar.
Figure 4:
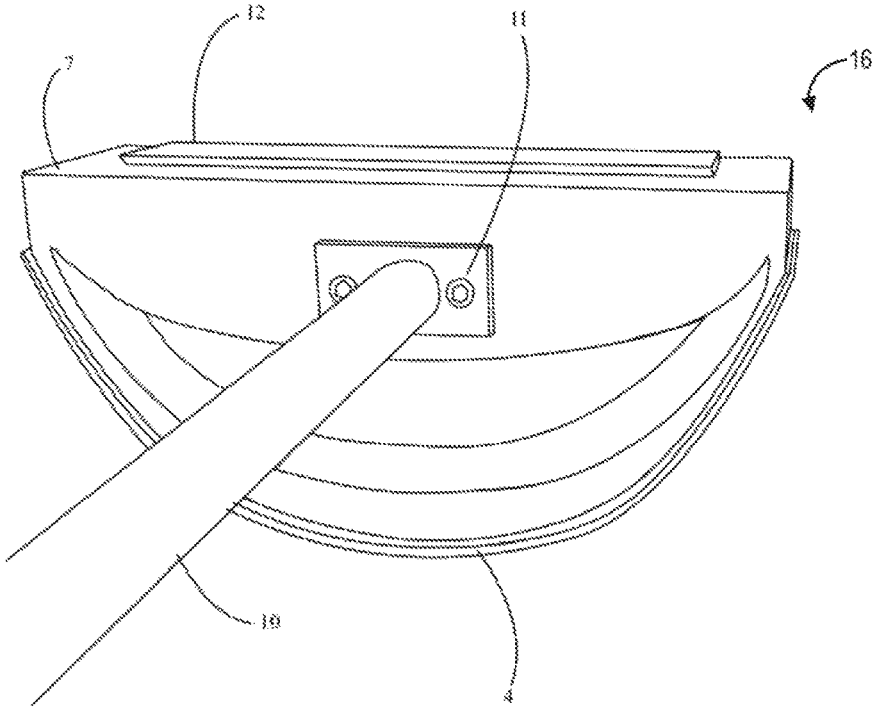
FIG. 4 shows a rear exploded perspective view of a foot pad of the balancing push up bar.
Figure 5:
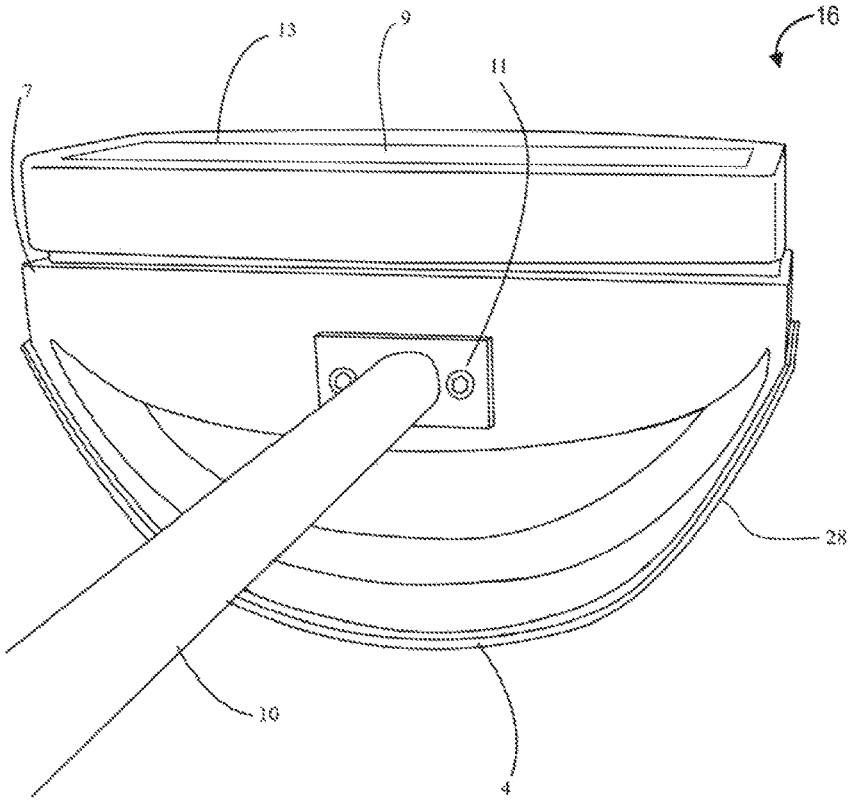
FIG. 5 shows a rear exploded perspective view of the foot pad with a cushion.
Figure 6:
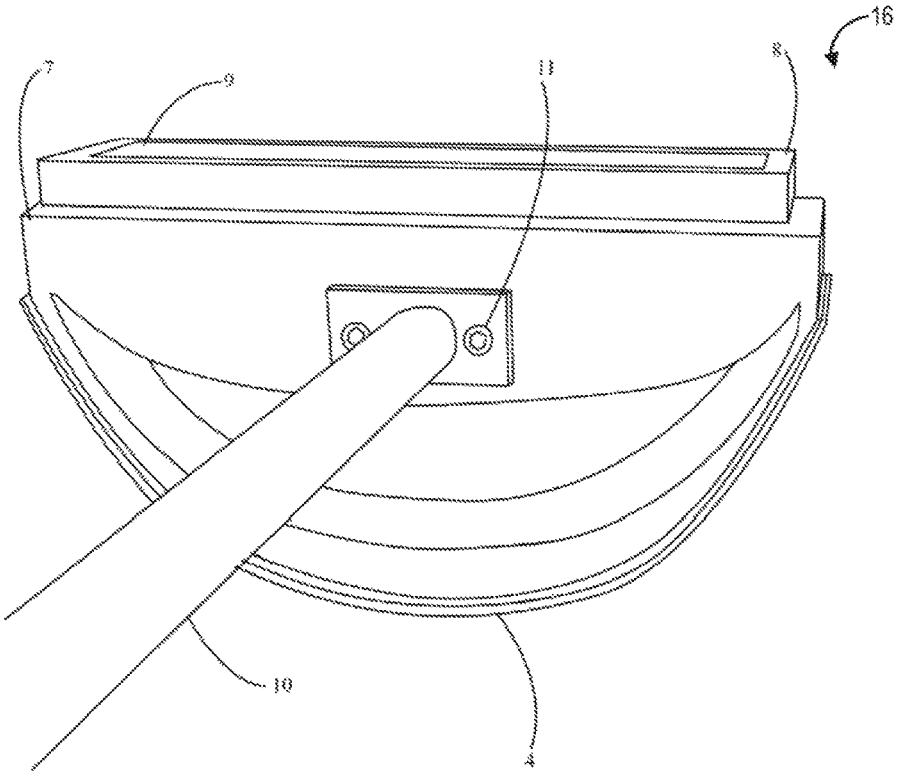
FIG. 6 shows a rear exploded perspective view of the balancing push up bar, with the foot pad removed.
Figure 7:
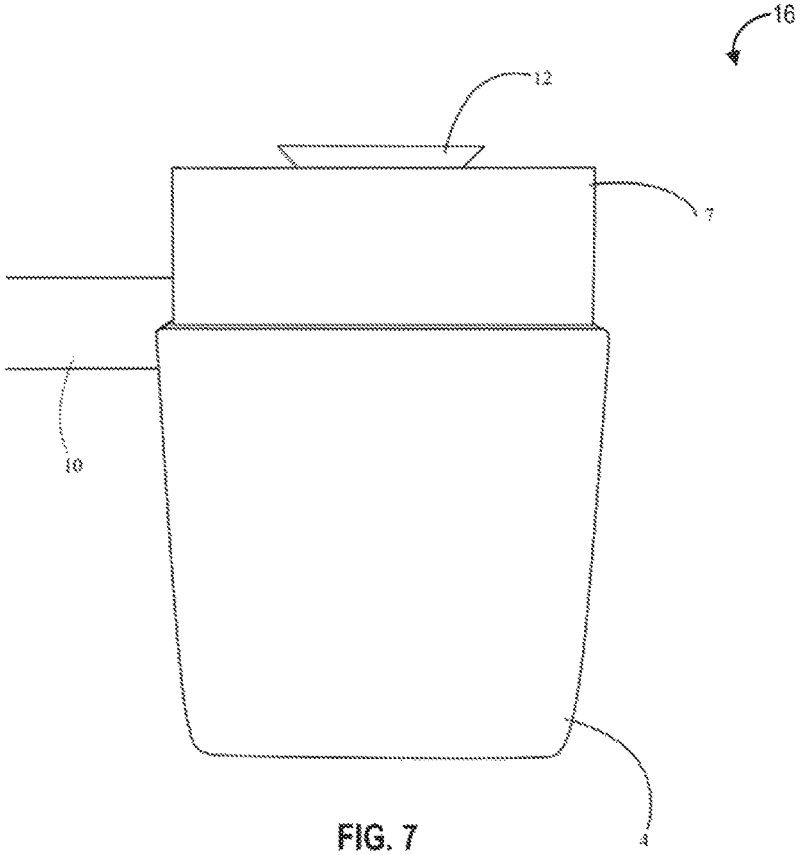
FIG. 7 shows an exploded side view of the balancing push up bar.

Following is a list of elements corresponding to a particular element referred to herein:

1 front pad
2 rod
3 handles
4 grip pad
5 rotating locking mechanism
6 locking lever
7 pad
8 top padding
9 grip tape
10 bar
11 screws
12 railing
13 interchangeable tops
14 front block
16 rear block
18 first side
20 second side
22 first extender
24 second extender
25 balancing push up bar
26 first arc
28 second arc
30 handles
32 first surface
34 second surface
35 feet
36 first portion
38 second portion
40 knees
45 user Referring now to FIGS. 1A-9, the present invention features a balancing push up bar (25) for exercising core muscles of a user. In some embodiments, the push up bar may comprise a front block (14), a rear block (16), and a bar (10) coupling the front block (14) to the rear block (16). Herein, the front and the rear block are separated by a distance which is substantially equal to a length of the bar (10). Without wishing to limit the invention to a particular mechanism, a shape profile of each of the front block and the rear block provide a rocking motion of the balancing push up bar (25). As a non-limiting example, the shape profile may include a round structure that provides the rocking motion. For example, the structure may include, but is not limited to, an oval shape, a circular shape, an elliptical shape, an arc shape, and the like. In a non-limiting embodiment, the front block (14) may include a first arc (26) orthogonal to the bar (10) and the rear block (16) may include a second arc (28). The first arc and the second arc may be interchangeably referred to as a front arc and a rear arc, respectively. The first and second arcs may rest on the ground, and the arc shape of the front arc and the rear arc can generate a rocking movement of the first and the rear block. Herein, the first arc (26) and the second arc (28) may be curved upward from a center point C of the first and second arcs. As such, the curvature of the first and the second arcs allow the user to experience a side to side rocking motion when the push up bar is used for exercising, as discussed further below. In some embodiments, the first and the second arc may be convex, or any geometric or irregular shape that provides the rocking motion, without deviating from the scope of this invention.

More specifically, the first arc (26) of the front block (14) allows the front block to rock back and forth from a first side (18) to a second side (20), wherein the first side and the second side are diametrically opposite sides of the front and the rear blocks. Likewise, the second arc (28) of the rear block (16) allows the rear block (16) to rock back and forth from the first side (18) to the second side (20). The back and forth rocking movement of the first and the rear blocks is used for balancing exercises, as discussed below.

In some embodiments, the front block (14) may be larger than the rear block (16), wherein a radius of the first arc (26) may be larger than a radius of the second arc (28). Without deviating from the scope of the invention, in some embodiments, the front block (14) may be equal in size or smaller than the rear block (16). In such embodiments, the radius of the first arc (26) may be substantially equal to or smaller than the radius of the second arc (28), respectively.

The front block (14) comprises a first extender (22) that extends from a first surface (32) of the front block (14) towards the first side (18). Herein, the first extender (22) projects or extends away from the front block (14) and towards the first side (18). The front block additionally comprises a second extender (24) extending from a second surface (34) towards the second side (20), the second extender (24) projecting or extending away from the front block (14) towards the second side (20). The first surface (32) and the second surface (34) are located on diametrically opposite sides of the front block (14). As a non-limiting example, the first extender and the second extender may include cylindrical rods that are removably or detachably coupled to opposite sides of the front block (14). The first and the second extender may be removed or pivotably moved when the push up bar (25) is not in use or stowed away. In some embodiments, the user may be able to hold on to the first and the second extenders by directly grabbing on to the cylindrical rods of the first and second extender. In some embodiments, handles (3) may be included in the first and the second extender, and the user may be able to hold on to the handles (3) while supporting himself/herself on the push up bar. The handles may be disposed at or near the distal ends of the first and the second extender.

In some embodiments, the front block (14) may include a front pad (1). The front pad may be disposed on a top surface of the front block. In other embodiments, the front pad may comprise a plurality of handles (30) disposed on the front pad. These handles may project upwardly from the front pad. Thus, the user can have several options to hold onto: the first and the second extenders, handles (3) coupled to the first and second extenders, or the handles (30) mounted on the front pad (1) of the front block (14). In this way, the user may be able to choose from several options to comfortably position the user's arm on the front block (14) and align the upper portion of the body in the balancing push up bar (25).

In some embodiments, the first arc (26) may comprise a grip pad (4) coupled to a bottom portion/surface of the first arc (26). In some embodiments, the grip pad (4) may form a lining along the bottom portion of the first arc (26). In some embodiments, an additional grip pad may line along a bottom surface of the second arc (28). As such, the grip pads lining along the bottom portions may serve to hold the push up bar (25) and reduce slipping of the push up bar (25).

Figure 8:
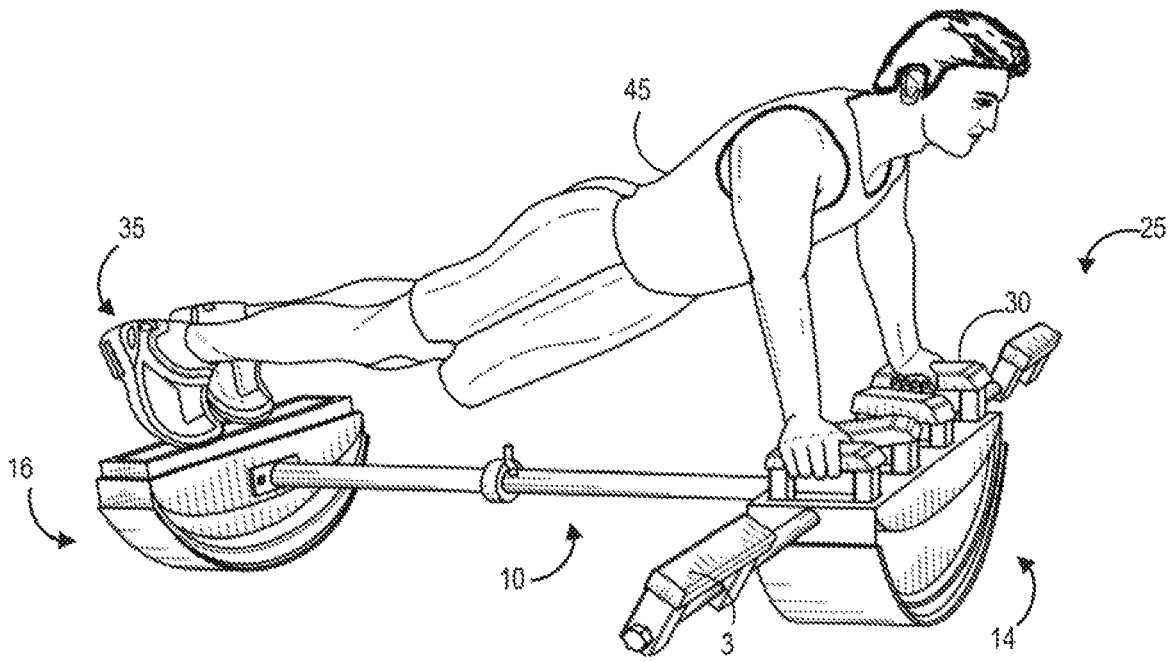
FIG. 8 shows a non-limiting example position with user's feet placed on a rear block of the balancing push up bar.

In some embodiments, the user may additionally rest a lower portion of the body on the rear block (16). Herein, the user may rest his/her feet or knees on the rear block (16) depending on the type of mode or form of exercise that is desired, as discussed further below. Thus, the user may mount on the balancing push up bar (25) by resting the arms on the front block (14) and feet/knees on the rear block (16). As shown in FIG. 8, a user (45) may hold handles (30) of the front block (14) and rest the feet (35) on the rear block (16). The user (45) may be able to hold on to handles (3) coupled to the first and second extenders, in some examples. In this way, the user (45) may be able to balance on the balancing push up bar (25) while performing push ups in the stretched position as shown in FIG. 8. As explained further below, the rear block may include additional grip pads to prevent the feet (35) from slipping off the rear block (14). In some embodiments, the user (45) may be able to position knees (40) on the rear block (16) while holding onto the handles (3 or 30) coupled to the front block (14). As explained further below, the rear block (14) may include additional pads for comfort.

In some embodiments, the balancing push up bar may include reinforcements that stabilize the bar when the user is initially mounting onto the bar. When included, the reinforcements may be retracted once the user is comfortably mounted on the bar and is ready to begin the exercise. Once mounted on the balancing push up bar (25), the arc shaped front the rear blocks may begin to create a rocking movement of the push up bar. Without wishing to limit the invention to a particular mechanism, in order to stay balanced on the balancing push up bar, the user may need to use the core muscles. In this way, the act of balancing on the push up bar (25) allows for an easy and effective way for working out the core muscles, thus strengthening the core of the user.

In some embodiments, the front pad (1) may be replaced by a grooved attachment (not shown in FIGS. 1A-9) that accepts a rod (2). Herein, the rod (2) may rest within the groove of the grooved attachment, and the user may be able to hold on the rod (2) while mounted on the balancing push up bar (25). In such an embodiment, the rod (2) may be a single piece that extends from the first side (22) towards the first surface (32) of the front block and extends further towards the second surface (34) and out towards the second side (20). In summary, the rod (2) may replace the first and the second extenders and may be held in place by the groove that is formed on the top surface of the front block (14).

Figure 9:
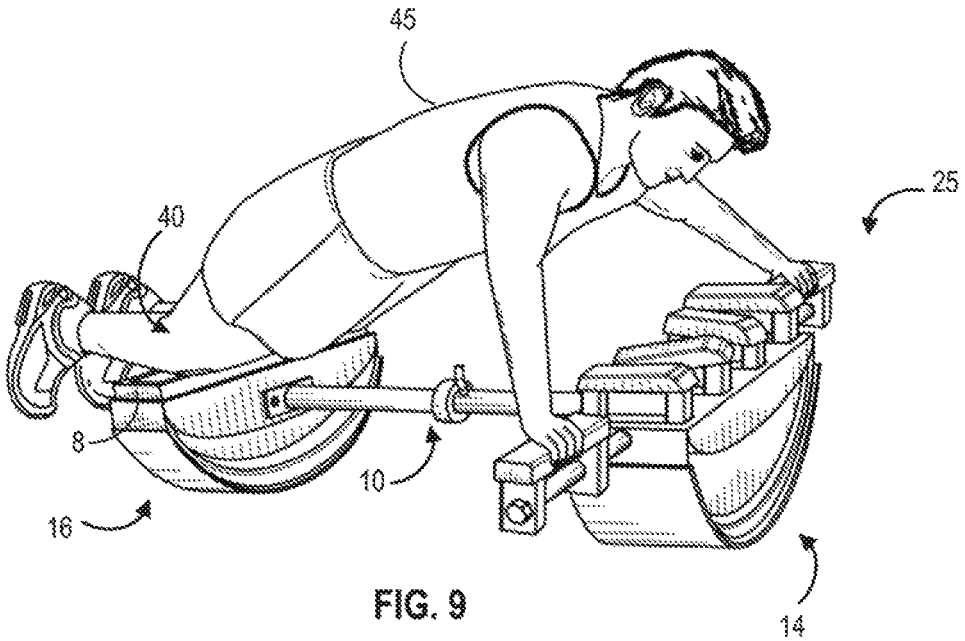
FIG. 9 shows a non-limiting example position with user's knees placed on the rear block of the balancing push up bar.

As discussed previously, the user may be able to rest his/her feet or knees on the rear block (16). The rear block (16) may include a pad (7) that is removably attached to the rear block (16) which includes a top padding (8). As such, the top padding (8) may provide some comfort when the user is resting the knees on the rear block (16) (FIG. 9). The rear block (16) may additionally include a grip tape (9) that is applied to the top padding (8). Herein, the grip tape (9) may provide a grip support when the user rests the feet on the rear block (16) (FIG. 8), thus preventing the feet from slipping off the rear block (16) when the user is mounted on the balancing push up bar (25), for example. In some embodiments, a railing (12) may be included in the rear block (16) that allows for interchangeable tops (13) to be used for the rear block (16).

The bar (10) that couples the front block (14) with the rear block (16) may be adjustable in length. As an example, the bar (10) may include a first portion (36) extendably coupled to a second portion (38). In a non-limiting embodiment, the first portion (36) may comprise a rod of larger diameter which slides over the second portion (38) (having a smaller diameter). Without deviating from the scope of the invention, in other embodiments, the second portion (38) may be larger in diameter and slide over the first portion (36), thereby extending and contracting the bar (10). The first portion (36) may be coupled to the front block (14) and the second portion (38) may be coupled to the rear block (16) using screws (11). The first and the second portions may be moved relative to one another using a rotating locking mechanism (5). As such, the rotating locking mechanism (5) of the bar (10) allows lengthening and shortening of the bar.

In a non-limiting example, the bar (10) may be a metallic bar. Once a desired length of the bar (10) is reached, the bar (10) may be locked using a locking lever (6). In a non-limiting example, rotating the locking lever in the clockwise direction may lock the bar (10), thereby fixing the length of the bar (10'). Fixing the length of the bar, fixes the distance between the front and the rear blocks, for example. It may be appreciated that though the distance between the front and the rear block is fixed by locking the lever (6), the front and the rear blocks may continue to undergo rocking motion. In some examples, rotating the locking lever (6) in the counter clockwise direction may unlock the bar (10) thereby allowing the first portion (36) to slide freely over the second portion (38). In this way, a distance between the front and the rear block may be adjusted. Thus, the present invention allows for users of different heights to interchangeably use the bar, by simply adjusting the length of the bar based on the user's height. When the user is mounted on the balancing push up bar (25), the bar (10) may be parallel to the ground on which the front and the rear blocks are resting and orthogonal to each of the first extender (22) and the second extender (24).

As previously discussed, the act of balancing on the balancing push up bar (25) works out the core muscles. In addition, the present invention provides for operating the balancing push up bar (25) in several modes to cater to needs of different users, as discussed below.

The balancing push up bar (25) is configured to operate in three modes, based on a difficulty level and a user experience. In a first mode, the user may mount on the balancing push up bar (25) and maintain a push up position. Herein, the push up position includes stretching the arms towards the front block (14) and holding handles (3 or 30) provided on the front block, and additionally, positioning the feet on the grip tape (9) of the rear block (16) (as shown in FIG. 8). The user may be able to fully extend by increasing the bar length according to a height of the user. Once the user is comfortably positioned on the balancing push up bar (25), the user may lock the bar length by rotating the locking lever (6), for example. In the first mode, the movement of the bar includes a rocking motion from the first side (18) to the second side (20). Herein, both the front block (14) and the rear block (16) rock from side to side. The user may counter balance the side to side movement by working the core muscles, while maintaining the push up position. In this way, the user may be able to use the balancing push up bar for strengthening the core muscles. In some embodiments, the first mode may be of medium difficulty level.

In a second mode, the user may replace the grip tape (9) with the top padding (8), and the user may additionally, position the knees on the top padding (8) (as shown in FIG. 9). The arms are stretched towards the front block (14) and the user holds onto handles (3 or 30). In the second mode, the user may be able to perform push ups on the knees. Like the first mode, both the front block (14) and the rear block (16) rock from side to side, and the user counter balances the side to side movement by working the core muscles, while maintaining the push up position on the knees. In this way, the user may be able to use the balancing push up bar for strengthening the core muscles. In some embodiments, the second mode may be of lower difficulty level.

In a third mode, the user may unlock the bar (10). Unlocking the bar (10) allows the lower body and the upper to move in different directions. More specifically, the movement of the front and the rear block is no longer restricted to the side to side movement. Thus, the front and the rear blocks are capable of moving in different directions. Without wishing to limit the invention to any particular mechanism, when the front and rear blocks are freely moving in all directions, the muscles need to work harder to maintain the balance on the bar. Thus, the third mode may be of a higher difficulty level, which provides greater strengthening of the core muscles, in the third mode, the user may be able to maintain a push up position similar to the first mode (on feet) or the second mode (on knees), for example.

In some embodiments, the user may be able to use a body force to control movement and balance on the push up bar (25) in the third mode. As an example, the user may be able to perform push ups while lengthening and shortening the bar using the body force, while maintaining the balance on the bar. In this way, the present invention provides for multiple ways for working out and strengthening the core muscles. Different users may use the balancing push up bar at a desired difficulty level. The parts of the balancing push up bar are easy to remove, and hence can be stored easily.

As used herein, the term "about" refers to plus or minus 10% of the referenced number.

Various modifications of the invention, in addition to those described herein, will be apparent to those skilled in the art from the foregoing description. Such modifications are also intended to fall within the scope of the appended claims. Each reference cited in the present application is incorporated herein by reference in its entirety.

Although there has been shown and described the preferred embodiment of the present invention, it will be readily apparent to those skilled in the art that modifications may be made thereto which do not exceed the scope of the appended claims. Therefore, the scope of the invention is only to be limited by the following claims. Reference numbers recited in the claims are exemplary and for ease of review by the patent office only, and are not limiting in any way. In some embodiments, the figures presented in this patent application may be drawn to scale, including the angles, ratios of dimensions, etc. In some embodiments, the figures are representative only and the claims are not limited by the dimensions of the figures. In some embodiments, descriptions of the inventions described herein using the phrase "comprising" includes embodiments that could be described as "consisting of", and as such the written description requirement for claiming one or more embodiments of the present invention using the phrase "consisting of" is met.

The reference numbers recited in the below claims are solely for ease of examination of this patent application, and are exemplary, and are not intended in any way to limit the scope of the claims to the particular features having the corresponding reference numbers in the drawings.

What is claimed is:

1. A method of performing a balancing exercise, the method comprising:

a. providing a balancing push up bar comprising:

i. a front block;

ii. a rear block;

iii. a bar coupling the front block to the rear block; and iv. a rod directed through the front block and comprising a first extender extending therefrom towards a first side and a second extender extending therefrom towards a second side that is opposite of the first side;

wherein a shape profile of each of the front block and the rear block provides a rocking motion of the balancing push up bar, wherein the balancing push up bar is configured to allow a user to hold onto the first extender and the second extender and to rest a lower portion of the user's body on the rear block, wherein the balancing push up bar is further configured to allow the user to use a body force to control movement and balance on the balancing push up bar;

wherein the bar is capable of being lengthened or shortened, wherein the bar comprises a locking lever configured to lock the bar at a set length;

b. operating the balancing push up bar in a first mode, the first mode configured to maintain a first position of the user wherein the user's arms rest on the front block while the user's feet rest on the rear block, wherein both the front block and the rear block of the balancing push up bar rock from the first side to the second side and the user maintains the first position while balancing rocking movement of the front block and the rear block, thereby simultaneously exercising both the user's upper and lower body;

c. operating the balancing push up bar in a second mode, the second mode configured to maintain a second position of the user by shortening a length of the bar, wherein the user's arms rest on the front block while the user's knees rest on the rear block, thereby allowing the user to perform push ups on the user's knees while simultaneously balancing on the balancing push up bar; and d. operating the balancing push up bar in a third mode, the third mode configured to move the bar by unlocking the locking lever and allowing both the user's upper and the lower body to move in different directions, thereby further strengthening the core of the user.

* * * * *